US005562394A

United States Patent [19]

Brown, Jr.

[11] Patent Number: 5,562,394

[45] Date of Patent: Oct. 8, 1996

[54] APPARATUS AND METHOD FOR INSERTING AND RETAINING CORE PLUGS IN PAPER ROLLS

[75] Inventor: Billy E. Brown, Jr., Alexander City, Ala.

[73] Assignee: Brown Paper Converting Machine Works, Inc., Alexander City, Ala.

[21] Appl. No.: 427,888

[22] Filed: Apr. 26, 1995

[51] Int. Cl.[6] ..... B66C 1/66

[52] U.S. Cl. ..... 414/626; 414/910; 294/67.31; 294/81.2

[58] Field of Search ..... 414/591, 626, 414/746.5, 910; 294/67.3, 67.31, 67.33, 81.2, 81.51, 81.54, 81.56

[56] References Cited

U.S. PATENT DOCUMENTS

| | | | |
|---|---|---|---|
| 1,426,764 | 8/1922 | Parker | 294/67.3 X |
| 1,736,016 | 11/1929 | Rosener | 294/67.31 X |
| 2,588,942 | 3/1952 | Still | 294/67.3 X |
| 3,076,673 | 2/1963 | Kaplan et al. | 414/626 X |
| 3,655,232 | 4/1972 | Martelee | 294/67.33 |
| 3,983,926 | 10/1976 | Müller | 294/67.33 X |
| 4,336,962 | 6/1982 | Read | 294/67.33 X |
| 4,563,031 | 1/1986 | Kishimoto et al. | 294/81.51 X |
| 4,842,473 | 6/1989 | Zbornik | 294/67.3 X |
| 5,114,200 | 5/1992 | Visnyouszky et al. | 294/81.56 |
| 5,445,426 | 8/1995 | Sorensen | 294/67.3 |

FOREIGN PATENT DOCUMENTS

| | | | |
|---|---|---|---|
| 0034817 | 2/1989 | Japan | 294/67.33 |
| 1486456 | 6/1989 | U.S.S.R. | 294/81.54 |

*Primary Examiner*—James W. Keenan
*Attorney, Agent, or Firm*—C. A. Phillips; Joseph H. Beumer

[57] ABSTRACT

Core plugs, which are intended for insertion in the ends of cores on which large rolls of paper are wound, are lifted and maneuvered into position by an apparatus having an elongated horizontal spreader beam that rides on an overhead track. The beam has support arms mounted on each end, the arms being movable horizontally on the beam by a worm gear apparatus. The support arms each carry a hook that reaches downward for grasping of axially extending stubs at the outer ends of core plugs. Each arm has a pneumatically actuated rod with a clamping block on its lower end. The blocks are projectable downward to engage the stubs and secure the core plugs in position on the hooks. Vertical movement of the plugs is provided by a hoist which raises and lowers the beam. With the plugs in place at each end, the paper roll is lifted onto a supporting cradle in position for insertion of spindles of a mill stand. This supports the roll as the paper is being unwound.

13 Claims, 2 Drawing Sheets

APPARATUS AND METHOD FOR INSERTING AND RETAINING CORE PLUGS IN PAPER ROLLS

FIELD OF THE INVENTION

This invention relates generally to handling of massive rolls of paper and more particularly to an apparatus and method of handling such articles without manual lifting of core plugs into position at the ends of a paper roll.

BACKGROUND OF THE INVENTION

Paper as produced by paper mills is normally provided in the form of massive rolls of continuous sheet material wound as a roll on a tubular core of material such as cardboard. Such rolls are typically 5 to 12 feet long, up to 8 feet in diameter, and have a weight of 1 to 4 tons. Further processing of the rolled-up paper requires placement of a generally cylindrical core plug or chuck within each end of the core. The plugs serve important functions in protecting the ends of the roll from damage and in providing a structure for rotatably mounting the roll on a pair of spindles of a mill stand, from which the material may be unwound in a controlled manner.

Industry practice for placement of core plugs to enable grasping and moving of paper rolls has comprised manually lifting and inserting the plugs by sliding them axially into the ends of the cores. This practice has presented a problem in that most core pugs have a weight in the range of some 50 to 125 pounds, which is just heavy enough to result in frequent back injuries to workers. In addition to the weight of the plugs, the awkward positions required to be assumed for this operation increase the likelihood of injuries.

In addition to the elimination of manual lifting steps in handling of core plugs, a need exists for securing them in position during necessary movements so as to preclude their sliding off of lifting equipment or damaging of end portions of the rolls.

SUMMARY OF THE INVENTION

The present invention is directed to an apparatus and method for handling of massive rolls of paper and for placing the rolls on a mill stand so as to enable further processing. This requires firmly grasping core plugs and lifting and guiding them into position at each end of a roll. Core plugs for which the invention is used will typically have a generally cylindrical body portion for insertion into a core end and, integral therewith, a smaller cylindrical stub extending axially outward from the core. The stub is adapted to receive and carry for rotation therein a spindle of a mill stand.

The apparatus of the invention comprises an elongated, horizontally disposed spreader beam movably connected to a horizontal track of an overhead crane apparatus; a pair of arms connected to and supported by housing frames mounted for sliding movement on each end of the beam; a pair of hooks mounted at the bottom of the arms; and locking members carried by the arms and associated with each hook for securing the hook against a stub member of a core plug. The apparatus also includes mechanisms for moving the beam vertically for lifting and for moving the arms horizontally together and apart from one another. Securing the core plugs in relation to the hooks may be carried out by downward projection of clamping blocks, which engage the tops of the stubs of the core plugs adjacent to the hooks. In order to provide a space for grasping of the stubs with the hooks, the stubs have an open area adjacent to the outer edge of the plug body. A pair of circumferentially extending flanges is located axially adjacent to the open area to limit axial movement of the clamping block. Movement of the clamping block may be accomplished by locating the blocks at the end of rods actuated by pneumatic cylinder and piston assemblies. In effect, a pair of rods move the locking blocks downward, snapping the blocks in position and forming a rigid connection. Safety of the apparatus may be further enhanced by inclusion of an automatic shutoff feature wherein an excess load condition is indicated by electrical current parameters, and machinery is turned off in response thereto.

Manual lifting of core plugs and the resulting exposure to conditions likely to result in injuries are avoided by the use of the invention. In addition, workers who are too weak for this work or who are partially disabled can easily operate the controls used for handling of core plugs according to the invention.

It is therefore an object of this invention to provide a method of installing core plugs in the ends of large rolls of paper without manually lifting the plugs.

Another object is to provide an apparatus for mechanically inserting core plugs in the ends of paper rolls.

Another object is to provide an apparatus for securely locking core plugs in operating position at the ends of paper rolls.

Other objects and advantages of the invention will be apparent from the following detailed description.

DESCRIPTION OF THE PREFERRED EMBODIMENT

Figure 1:
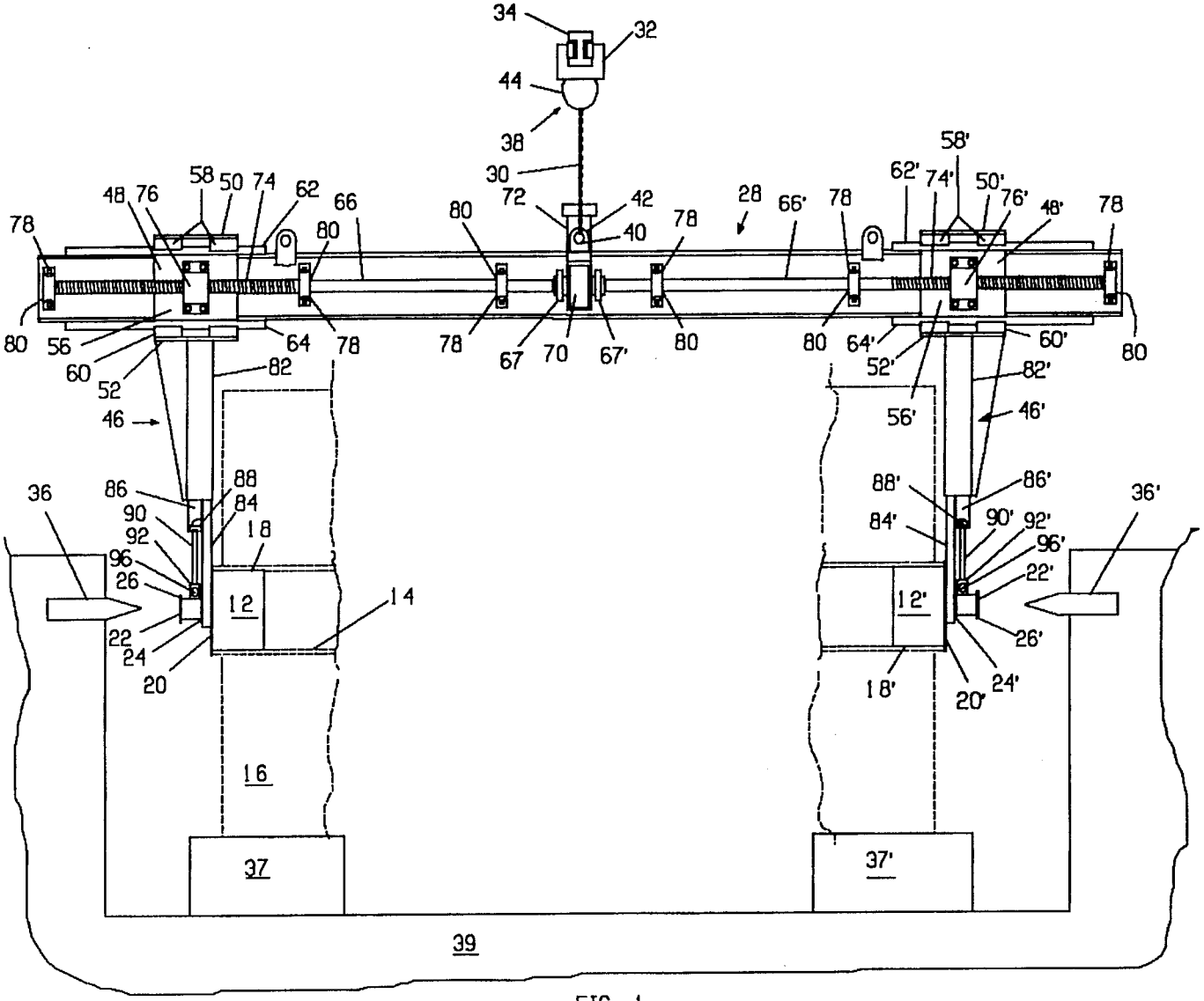
FIG. 1 is a frontal view, partially broken away,showing apparatus embodying the invention.

Referring to FIG. 1 of the drawings, there is shown an apparatus for handling of core plugs 12, 12'the apparatus being useful for performing the steps of lifting the plugs, inserting them into ends of a core 14 of a paper roll 16 and securing the plugs in the core until the roll can be placed in a mill stand. The core plugs, which are shown inserted in the core, have tubular wall portions 18, 18', hollow interiors, and outer end plates 20, 20' with cylindrical-shaped stubs 22, 22' integral with the plates and extending axially outward. Flanges 24, 24' and 26, 26' are disposed circumferentially around the stubs at spaced intervals away from the end plates, providing a recessed location for operation of a hook and locking block, as will be described below.

The apparatus includes an elongated box beam 28 connected by a chain 30 to a carriage 32 which is movable on a horizontal overhead crane track 34. Up and down movement of the beam is provided by chain 30 when actuated by hoist 38, the chain extending through aperture 40 of lifting pad 42 at the middle of the beam. The hoist is powered by an electric motor 44.

The box beam carries perpendicular thereto a pair of downward projecting arms 46, 46', which move vertically with the beam when the beam is raised and lowered, and which are movable horizontally toward and away from one another by action of a worm gear mechanism. This horizontal movement enables insertion of the plugs into a paper roll core. The worm gear mechanism 70 may comprise a worm gear driven by motor 72 and rotating shafts 66, 66' so as to move the arms together and apart. Couplings 67, 67' link shafts 66, 66' to opposed output shafts of the mechanism 70. The shafts 66, 66' have left- and right-hand threads 74, 74' which engage mating female threads in receiving blocks 76, 76' secured to support frames 48, 48'. A plurality of bearings 80 supported in blocks 78 are disposed along the lengths of the shafts for journalling the shafts.

The worm gear mechanism 70 may comprise a conventional gear having a 15:1 ratio and which is available from Boston Gear and identified as Catalog #18-15-65H. A shaft from the motor 72 is keyed into a mating shaft in the gear box mechanism.

Figure 2:
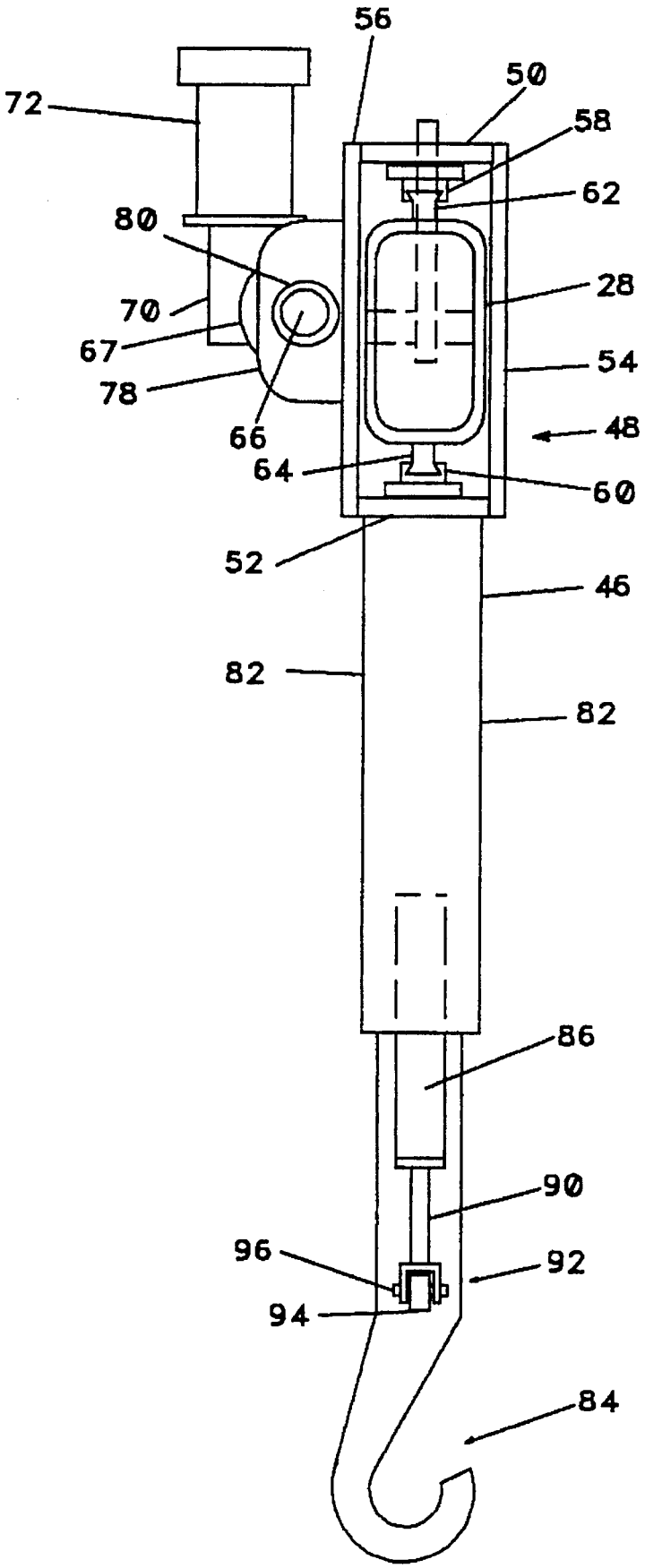
FIG. 2 is an end view, partly in dotted lines, showing a support arm and structure thereof for grasping of a core plug.

Arms 46, 46' are connected to rectangular support frames 48, 48' which extend around outside the periphery of box beam 28 and which move back and forth on the box beam in a sliding horizontal movement. Support frames 48, 48' have top plates 50 (FIG. 1); bottom plates 52; front plates 54 (FIG. 2); and back plates 56, 56', with sides of the frames being open to allow passage over the box beam. The underside of top plates 50 and the top side of bottom plates 52 each carry linear slide bearings 58, 58' , 60, 60' which engage linear slides 62, 64 (FIG. 2) attached to top and bottom sides, respectively, of the box beam. The slides and slide bearings are intermeshed in a dovetail fit. Slides at the ends of the beam extend over about ⅙ of the beam length, providing an operating range in which the arms may move. Arms 46, 46' have rectangular side plates 82, 82' welded to the support frames at the tops of the plates, providing a fixed attachment with respect to the frames. Hooks 84, 84' are rigidly attached to the arms by being welded to bottom ends of plates 82, 82'. The arms also carry pneumatic cylinders 86, 86' having pistons 88, 88' and outwardly projecting rods 90, 90'. Clamping blocks 92, 92' are connected to ends of the rods 90, 90' for movement downward to engage stubs of the core plugs. Blocks 92, 92' may comprise a circular wheel 94, 94' mounted for rotation on a bolt 96, 96' (FIG. 2), this structure enabling the blocks to move slightly in a self-adjusting manner upon coming into contact with the core plug stubs.

The rods and attached clamping blocks are located in a plane adjacent to and outside the planes of the hooks and are aligned to move radially with respect to the stubs. Outward movement of the core plug, once the clamping blocks are engaged, is prevented by flanges 24, 24' which would come into contact with the blocks. Engagement of the clamping block also serves to bring the core plug into better alignment, taking up any slack and "snapping" the plug into position.

The apparatus may be controlled by providing a hand-held control box or panel in which are carried switches for actuating the motors used to obtain vertical and horizontal movement. Conventional electrical switches and connecting wiring may be used for this purpose. As a safety feature, the electrical controls may include an automatic shutoff mechanism responsive to events such as jamming of a core plug against a core. This would produce a spike in current due to increased load, and the increased current may be sensed and used to actuate a shutoff switch. For example, in a 24-volt system, current in excess of 5 amperes for over 0.2 second is indicative of an excess load. A time-responsive circuit set to actuate shutoff upon lapse of 0.3 second at the higher current may be used.

In operation of the apparatus of the invention, the core plugs may initially be placed on the floor and rolled to locations where they are aligned for being reached by the hooks of the support arms. Upon grasping the core plugs as described above, the support arms are moved apart so as to extend the plugs outside the ends of and in axial alignment with a core into which they are to be inserted. By moving the arms together, the plugs are securely held in the core. The paper roll may then be placed on other equipment for unwinding of the paper as required. This other equipment may comprise a mill stand 39 as shown in FIG. 1 of the drawings. Initially, the roll would be placed on a cradle 37, 37' supporting the roll at both ends Spindles 36, 36', which ride on bearings in the mill stand, may then be inserted in both of the core plugs. Preferably, the cradle would support the roll at a level such that the spindles are slightly higher than the axis of the core plugs. This causes the roll to be elevated slightly by wedging action of a tapered end portion of the spindles, freeing the roll from contact with the cradle.

While the invention is described above in terms of a specific embodiment, it is not to be understood as limited to such embodiment, but is limited only as indicated by the appended claims.

I claim:

1. In combination a pair of core plugs insertable in ends of rolls having cores wrapped with sheet material, and an appartus for lifting and moving said core plugs, said plugs each having a generally cylindrical body, an outer end plate, and an axially outward extending cylindrical-shaped stub integral therewith comprising:

an overhead crane mechanism;

a pair of tubular side walls, one defined in each of said stubs;

an elongated horizontally disposed beam operably connected to said overhead crane mechanism enabling horizontal movement of the beam;

a hoist connected to said beam and adapted to raise and lower the beam;

a pair of vertically disposed arms carried by said beam at end portions thereof and slidably engaging said beam so as to allow horizontal movement of the arms toward and apart from one another;

a pair of grasping hooks, one of each fixedly connected to a said arm and adapted for movement in a radial direction with respect to a said stub so as to bring a said hook in contact with an outside surface of a said side wall, thus enabling engagement with said stub from underneath;

a pair of clamping blocks carried by said arms and projectable downward radially against said stubs; and actuator means for moving said arms and said clamping blocks.

2. The apparatus as defined in claim 1 including a pair of support frames extending around the outside of said beam at end portions thereof and each support frame having an arm joined thereto.

3. The apparatus as defined in claim 2 wherein each said support frame includes an upper plate and a bottom plate, the underside of said upper plate and the top side of said bottom plate each carrying a linear slide bearing, and said beam at the top and at the bottom thereof carrying a pair of linear slides adapted to be engaged by said linear slide bearings.

4. The apparatus as defined in claim 3 including a worm gear disposed at the middle of said beam and driving a pair of shafts engaging said arms so as to force said arms together and apart.

5. The apparatus as defined in claim 4 wherein said clamping blocks comprise a wheel and a bolt on which the wheel is mounted.

6. The apparatus as defined in claim 5 including a fluid cylinder carried by said arm and having attached thereto a downwardly moving piston and rod.

7. The apparatus as defined in claim 6 wherein said cylinder is a pneumatic cylinder.

8. The apparatus as defined in claim 7 wherein said hooks are disposed downward in planes parallel to said arms, and said clamping blocks are spaced apart from said planes a distance such as to enable the clamping blocks to engage an open space in said stubs on the outside of a flange thereof.

9. The apparatus as defined in claim 8 including motors powering said worm gear and said hoist.

10. The apparatus as defined in claim 9 including switching means for controlling said motors.

11. The apparatus as defined in claim 8 wherein said stubs each have an inner flange and an outer flange, and said blocks are arranged to engage an open space between said flanges.

12. The apparatus as defined in claim 1 wherein said hooks and said clamping blocks are arranged to engage said stubs at opposing positions on said side walls, thereby securely supporting said plugs for movement.

13. The apparatus as defined in claim 1 wherein said pairs of arms combined with said hooks connected thereto are each formed into a unitary rigid member disposed in perpendicular relation to said beam.

* * * * *